US005663544A

United States Patent [19]

Niemeyer

[11] Patent Number: 5,663,544

[45] Date of Patent: Sep. 2, 1997

[54] SWITCHING DEVICE HAVING A VACUUM CIRCUIT-BREAKER SHUNT CONNECTED WITH A GAS-BLAST CIRCUIT BREAKER

[75] Inventor: Lutz Niemeyer, Birr, Switzerland

[73] Assignee: ABB Research Ltd., Zurich, Switzerland

[21] Appl. No.: 532,654

[22] PCT Filed: Jan. 16, 1995

[86] PCT No.: PCT/CH95/00010

§ 371 Date: Nov. 20, 1995

§ 102(e) Date: Nov. 20, 1995

[87] PCT Pub. No.: WO95/22831

PCT Pub. Date: Aug. 24, 1995

[30] Foreign Application Priority Data

Feb. 18, 1994 [DE] Germany ..... 44 05 206.5

[51] Int. Cl.[6] ..... H01H 33/14; H01H 33/66

[52] U.S. Cl. ..... 218/3; 218/5; 218/6; 218/10

[58] Field of Search ..... 218/2–10, 43–88, 218/118–146

[56] References Cited

U.S. PATENT DOCUMENTS

| | | | |
|---|---|---|---|
| 4,087,664 | 5/1978 | Weston | 218/3 |
| 4,307,428 | 12/1981 | Yanabu et al. | 361/4 |
| 4,458,119 | 7/1984 | Hashimoto et al. | 218/3 |
| 4,617,435 | 10/1986 | Kawasaki | 218/143 |
| 4,814,559 | 3/1989 | Stegmuller | 218/3 |
| 5,276,286 | 1/1994 | Demissy et al. | 218/10 |
| 5,347,096 | 9/1994 | Bolongeat-Mobleu et al. | 218/84 |

FOREIGN PATENT DOCUMENTS

| | | | |
|---|---|---|---|
| 0092205 | 10/1983 | European Pat. Off. | H01H 33/12 |
| 2189916 | 1/1974 | France | H02K 11/00 |
| 2682807 | 4/1993 | France | H01H 33/66 |
| 1265815 | 4/1968 | Germany | H01H 33/60 |
| 3131271A1 | 8/1982 | Germany | H01H 33/14 |
| 3705719 | 9/1988 | Germany | H01H 33/12 |

*Primary Examiner*—J. R. Scott

*Attorney, Agent, or Firm*—Burns, Doane, Swecker & Mathis, L.L.P.

[57] ABSTRACT

A device for switching electric current includes a compressed gas switch, at least one vacuum switch, and two terminals. A first consumable contact of the compressed gas switch is electrically connected to a first of the two terminals and a movable electrode of the vacuum switch is connected to a second of the two terminals to form a quenching circuit. The two electrodes of the vacuum switch can be separated without the use of the drive and a contact pressure is applied to them which prevents the electrodes from breaking below a threshold value of the current to be switched off. On switch-off, the current to be interrupted is switched over from a rated current circuit containing two rated current contacts of the compressed gas switch to the parallel quenching circuit. The vacuum switch now in the quenching circuit breaks only if the current to be switched off exceeds the aforementioned threshold. As the vacuum switch does not conduct the rated current and, unlike the compressed gas switch, is involved only in a few break operations, it can be of substantially lighter construction than a vacuum switch carrying the rated current and is actuated in every switching operation.

14 Claims, 4 Drawing Sheets

SWITCHING DEVICE HAVING A VACUUM CIRCUIT-BREAKER SHUNT CONNECTED WITH A GAS-BLAST CIRCUIT BREAKER

BACKGROUND OF THE INVENTION

1. Field of the Invention

The invention is based on a switching device. A switching device of this type is preferably used in a high-voltage power supply and preferably serves there to switch large currents having a high transient recovery voltage rate.

2. Discussion of Background

The invention refers to a prior art such as is specified, for example, in U.S. Pat. No. 4,087,664. A switching device for a high-voltage power supply described in this prior art contains two current connections, between which a compressed gas-blast circuit-breaker having $SF_6$ as quenching gas and a vacuum circuit-breaker are arranged in series. The vacuum circuit-breaker is designed such that it can carry and switch both rated and short-circuit currents. Such a vacuum circuit-breaker is therefore very costly. In addition, the vacuum circuit-breaker is driven separately from and in synchronism with the compressed gas-blast circuit-breaker. Since the vacuum circuit-breaker has a considerably smaller travel than the compressed gas-blast circuit-breaker, this produces, moreover, a considerable outlay for the drive and control of the vacuum circuit-breaker. In addition, the vacuum circuit-breaker requires a very high contact pressure force in order to prevent premature lifting off of its electrodes, through which, if appropriate, short-circuit current flows, in the switched-on state.

SUMMARY OF THE INVENTION

Accordingly, one object of the invention is to provide a novel switching device of the type mentioned in the introduction, which can be produced and operated with little outlay and which, nevertheless, can interrupt large currents having a high transient recovery voltage rate.

The switching device according to the invention is distinguished by virtually maintenance-free operation and an outstanding switching capacity. Since there are no stringent requirements imposed on the at least one vacuum circuit-breaker in respect of the breaking capacity and the continuous current-carrying capacity, the switching device according to the invention can also be produced extremely cost-effectively. The at least one vacuum circuit-breaker can be a standard product which is used in large numbers in medium-voltage technology and is therefore particularly inexpensive. This is due to the fact that the at least one vacuum circuit-breaker is shunt-connected with a rated current path of the compressed gas-blast circuit-breaker and therefore carries, during rated current operation, at most a small fraction of the rated current flowing through the switching device. It is not until a specific short-circuit current value is exceeded that the vacuum circuit-breaker of the switching device according to the invention is commutated into the current path which now carries short-circuit current. The high short-circuit current flowing through the Vacuum circuit-breaker generates large electrodynamic forces which drive the electrodes of the vacuum circuit-breaker apart and thus interrupt the short-circuit current.

These electrodynamic forces are completely sufficient, given appropriate dimensioning of the short-circuit current-carrying path, to separate the electrodes of the vacuum circuit-breaker from one another to such an extent that the interruption of the short-circuit current is ensured.

It is additionally possible, as a result of suitable arrangement of the vacuum circuit-breaker, also to utilize drive assistance, which is easy to coordinate, from the compressed gas-blast circuit-breaker during the separation of the electrodes by the electrodynamic forces of the short-circuit current.

A particularly advantageous design of the switching devices according to the invention does not contain the at least one vacuum circuit-breaker, but rather a module having two or more identical vacuum circuit-breakers which are aligned and connected in parallel with one another. Such a module has the additional advantage that, as a result of the division of the short-circuit current between a plurality of small vacuum circuit-breakers having a low breaking capacity, the switching device according to the invention can be produced particularly cost-effectively. Preference is given here to the use of a module having three identical vacuum circuit-breakers which are connected in parallel with one another and are arranged with parallel alignment at the corners of an equilateral triangle. In the case of a module having such a design, low-inductance current conduction is achieved, the current to be disconnected is distributed uniformly between the three vacuum circuit-breakers, and the electrodynamic forces effecting the drive of the electrodes are divided symmetrically between the three vacuum circuit-breakers.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a plan view of an embodiment, which is illustrated in section, of a first switching device according to the invention having a module containing a plurality of vacuum circuit-breakers.

DESCRIPTION OF THE PREFERRED EMBODIMENTS

Figure 4:
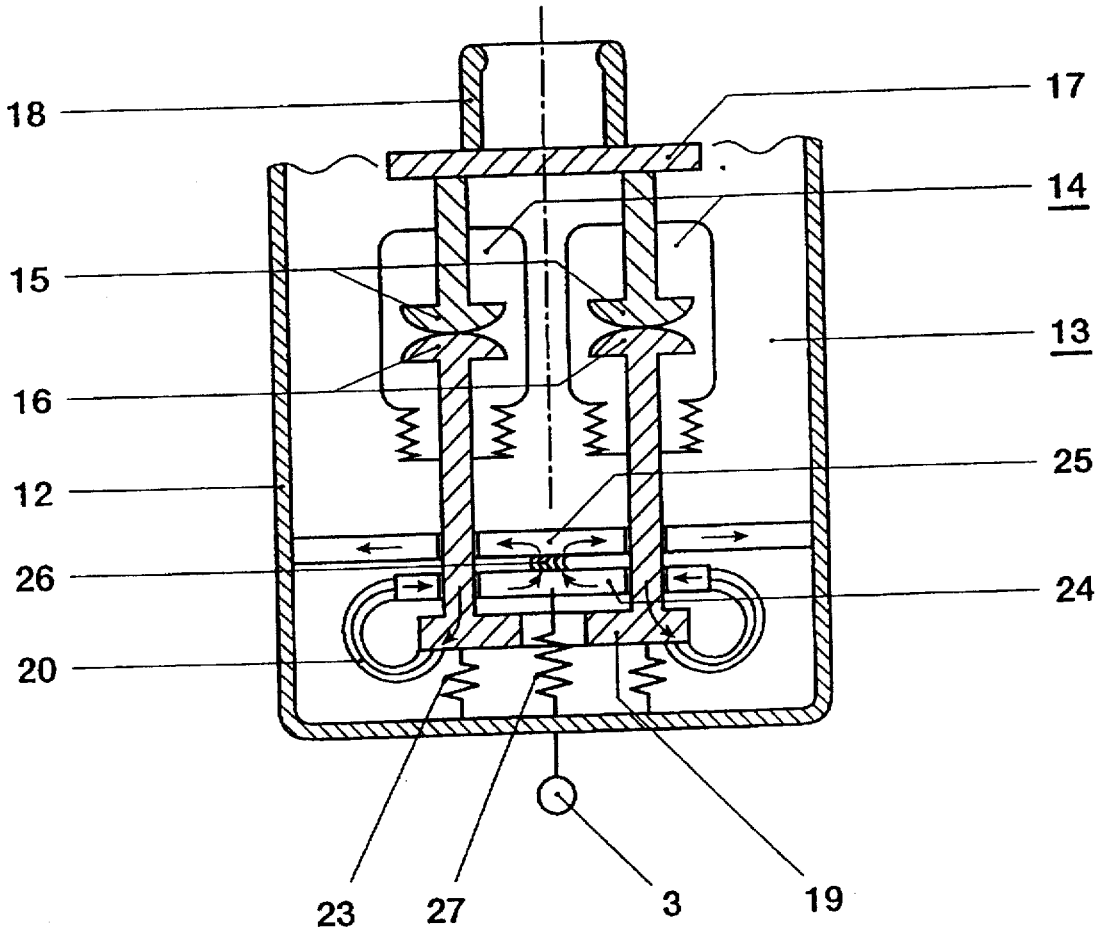
FIG. 4 shows a plan view of a third embodiment, which is illustrated in section, of the module of the switching device in accordance with FIG. 1.

Referring now to the drawings, wherein like reference numerals designate identical or corresponding parts throughout the several views, the switching device illustrated in FIG. 1 is intended for use in high-voltage power supplies with voltages typically of 100 kV or more and contains a cylindrical housing 1 which is filled with $SF_6$ or another insulating gas, has a shell made of insulating material and has two covering plates, the top covering plate of which serves as one of two current connections 2, 3 of the switching device. The top covering plate carries a sliding contact 4 and has an opening (not designated) through which a contact member 6 is guided out of the housing 1, which contact member 6 can be displaced by a drive 5 (illustrated as an arrow) in the direction of the axis of the housing 1 and with which the contact 4 makes sliding contact. The contact member 6 has at its free end which is remote from the drive 5, in a coaxial arrangement, a hollow erosion contact 7 and a hollow rated current contact 8 which surrounds the erosion contact. The bottom covering plate of the housing 1 is designed as a disk insulator 9 and carries an erosion contact 10 which is aligned along the axis of the housing 1 and is guided by the disk insulator 9. A rated current contact 11 which concentrically surrounds the erosion contact 10 is flanged onto that side of the disk insulator 9 which points into the interior of the housing 1, whereas a metal housing 12 of a module 13 is flanged onto the opposite side of the disk insulator 9.

The module 13 contains at least one vacuum circuit-breaker 14, preferably a plurality of identical vacuum circuit breakers, and more preferably three identical vacuum circuit-breakers 14 which are arranged to be distributed axially symmetrically about the axis of the housing 12 and of which only two are illustrated. The vacuum circuit-breakers have relatively small dimensions and each have a relatively low high-voltage switching capacity. Therefore, the vacuum circuit-breakers 14 used may take the form of inexpensive standard products such as, for example, vacuum tubes which are produced in large numbers for voltages typically of 10 to 40 kV. Each of the vacuum circuit-breakers 14 has a stationary electrode 15 and a movable electrode 16. The stationary electrodes 15 of the vacuum circuit-breakers 14 are fixed to one side of a contact bridge 17 in the form of a plate. On the opposite side, the contact bridge 17 carries a hollow contact 18. This hollow contact is electrically conductively engaged with a mating contact (not designated) of the compressed gas-blast circuit-breaker, which is provided on that end of the erosion contact 7 which is guided out of the housing 1. The movable electrodes 16 of the vacuum circuit-breakers 14 are rigidly held by a current collector 19 in the form of a plate and are electrically conductively connected to the current connection 3 of the switching device via the current collector 19, flexible conductor elements 20 and a section of the module housing 12 which is designed to be conductive. The current collector 19 is acted on by a drive system 21, which is actuated exclusively by a short-circuit current which flows through the vacuum circuit-breakers 14 in the event of a switch-off operation.

In the case of this switching device, rated current is predominantly routed in the switched-on state (right-hand part of FIG. 1) in a rated current path embracing the current connection 2, the sliding contact 4, the rated current contacts 8, 11, flange connecting screws 22, the housing 12 and the current connection 3. On account of the relatively high resistance, a comparatively small proportion of the rated current is routed in an extinction current path which is connected in parallel with the rated current path. This extinction current path embraces the current connection 2, the sliding contact 4, the erosion contacts 7, 10, the hollow contact 18, the contact bridge 17, the electrodes 15 and 16 of the vacuum circuit-breakers 14 which are connected parallel with one another, the current collector 19, the flexible conductor elements 20, the housing 12 and the current connection 3. Since the vacuum circuit-breakers carry virtually no rated current, they can have small dimensions.

In the event of switching off rated current (left-hand part of FIG. 1), the drive 5 moves the contact member 6 upward in the direction of the arrow. Initially, the two rated current contacts 8, 11 are separated from one another and the current to be disconnected is commutated from the rated current path into the extinction current path. As a result of the subsequent separation of the erosion contacts 7 and 10, the current to be disconnected is then interrupted by the compressed gas-blast circuit-breaker in the extinction current path.

In the event of switching off short-circuit current, the current to be disconnected commutates into the extinction current path in accordance with the above-described switching operation. This current is uniformly divided in the region of the vacuum circuit-breakers 14, with the result that each circuit-breaker has to carry only a fraction of the short-circuit current. The two electrodes 15, 16 of the vacuum circuit-breakers can be separated from one another without using the drive 5. They receive from the drive system 21 a contact force which prevents separation of the electrodes 15, 16 below a limit value of the short-circuit current. Therefore, not only rated currents but also comparatively low short-circuit currents are disconnected exclusively by the compressed gas-blast circuit-breaker. However, if the magnitude of the short-circuit current exceeds the limit value, then the drive system 21, without any external driving, causes the electrodes 15, 16 to open and the short-circuit current to be disconnected. The vacuum circuit-breakers 14 are therefore actuated only when this is absolutely necessary—such as, for example, in the event of disconnecting large short-circuit currents. Therefore, they can be designed only for a small number of switching operations. The initial recovery voltage having a high recovery rate which occurs here can be maintained without any problems by the series-connected, open switching points of the compressed gas-blast circuit-breaker and of the vacuum circuit-breakers.

Figure 2:
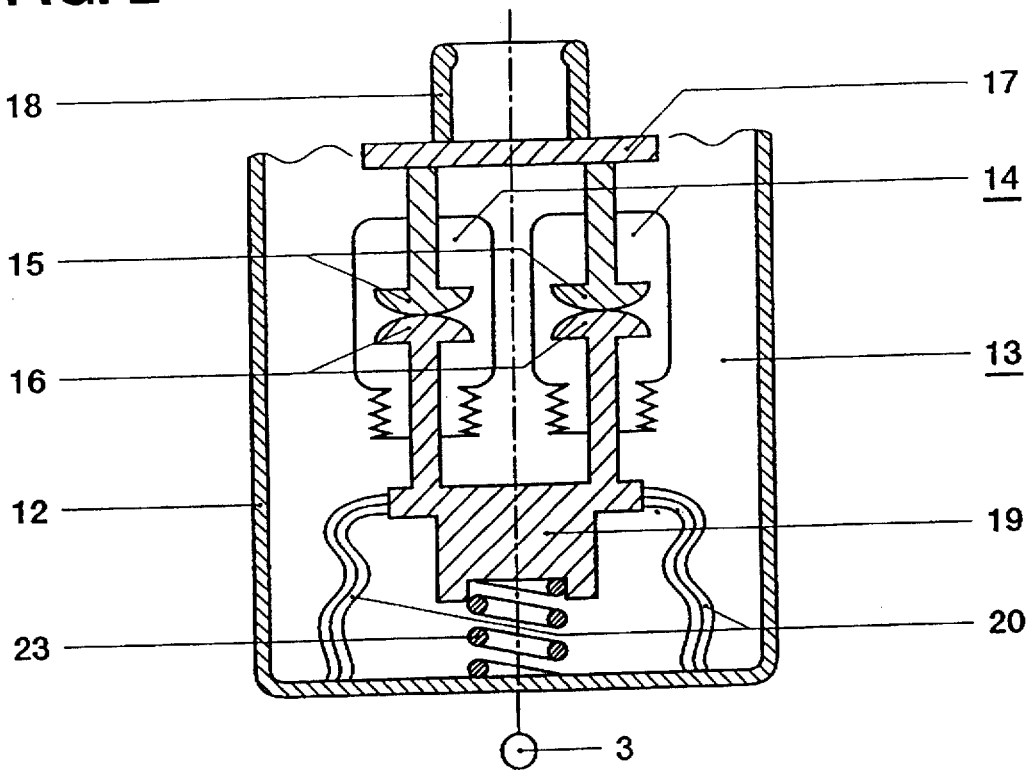
FIG. 2 shows a plan view of a first embodiment, which is illustrated in section, of the module of the switching device in accordance with FIG. 1.
Figure 3:
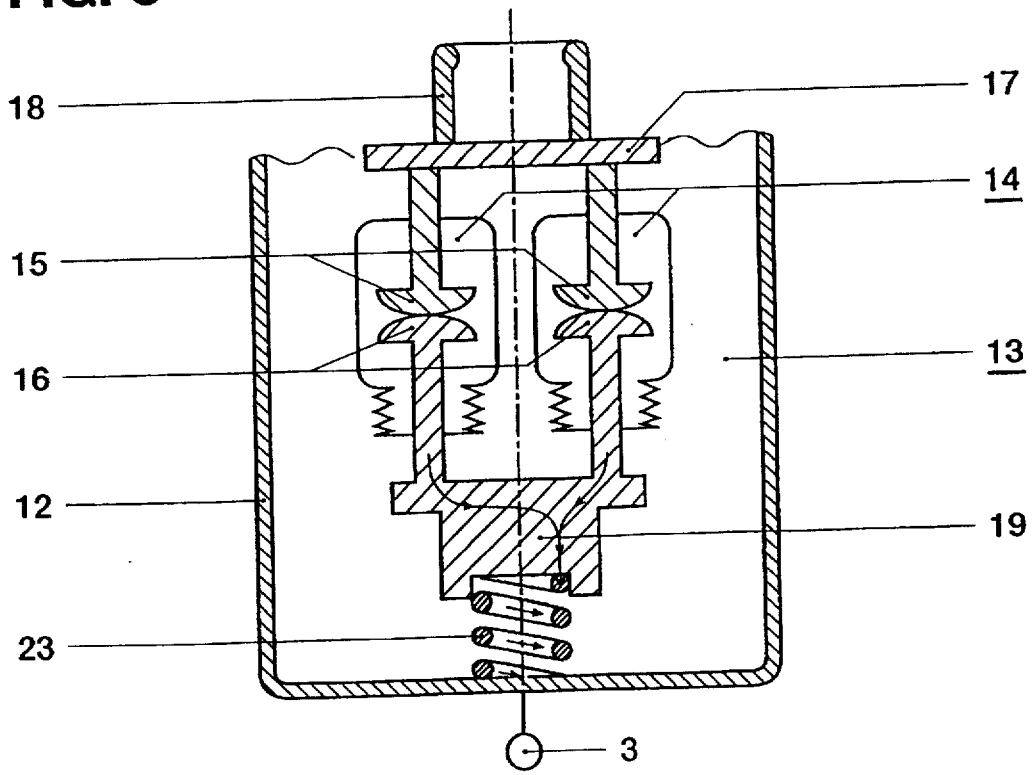
FIG. 3 shows a plan view of a second embodiment, which is illustrated in section, of the module of the switching device in accordance with FIG. 1.
Figure 4:
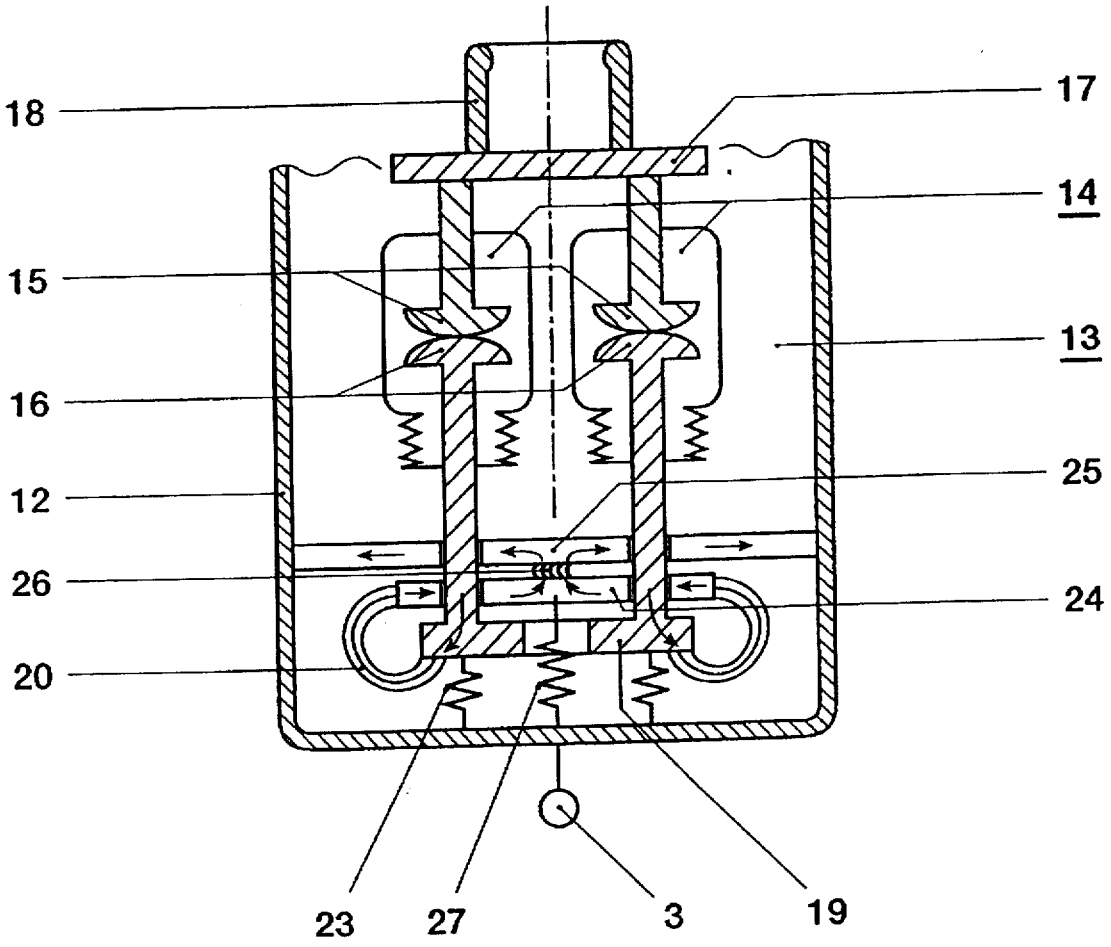

FIGS. 2 to 4 illustrate three modules 13 having differently designed structures of the drive system 21. In the case of the embodiment illustrated in FIG. 2, a preferably helically or spirally curved contact pressure spring 23 is provided, which is supported by its upper end on that side of the current collector 19 which is remote from the electrodes 16 and by its lower end on the housing 12. This spring produces the desired contact pressure force of the electrodes 15, 16. The desired force can easily be set by suitably prestressing the contact pressure spring 23, for example by means of an adjusting screw (not illustrated) guided in the housing 12. When the limit value, which is defined by the contact pressure force, of the current to be disconnected is exceeded, the electrodes 15, 16 are separated from one another on account of the electrodynamic forces of the current and the current is interrupted in the vacuum circuit-breakers 14. The spring constant of the spring 23 and the inertial masses of the current collector 19, of the movable electrodes 16 which are rigidly connected thereto and also of further moving parts of the module 13, such as the flexible conductor elements 20, are dimensioned in such a way that, during a switch-off operation, the electrodes 15, 16 are not closed until after the current to be disconnected has definitely been interrupted. This largely prevents welding of the electrodes 15, 16 of the vacuum circuit-breakers 14.

In the case of the embodiment illustrated in FIG. 3, the contact pressure spring 23 simultaneously serves to route the current to be disconnected. When a large short-circuit current occurs, this spring contracts to a large degree and thus assists the electrodynamic forces in opening the electrodes 15, 16. The flexible conductor elements 20 are omitted in this embodiment.

In the case of the embodiment illustrated in FIG. 4, a movable striker armature 24 and a stationary busbar 25, which interacts with the striker armature 24, are arranged in the extinction current path between the current collector 19 and the current connection 3. The striker armature 24 and the busbar 25 form a parallel-running conductor pair. The striker armature 24 is arranged above the current collector 19 and has openings through which the electrodes 16 of the vacuum circuit-breakers 14 are guided displaceably in the direction of the axis of the compressed gas-blast circuit-breaker. The busbar 25 is rigidly fixed to the wall of the housing 12 above the striker armature 24. The flexible conductor elements 20 are routed from the current collector 19 to the two ends of the striker armature 24. The center of the striker armature 24 is electrically conductively connected to the center of the busbar 25 via a flexible conductor element 26. A spring 27 presses the striker armature 24 against the stationary busbar 25.

As illustrated by arrows, the current which is commutated into the extinction current path during switching off flows, in the striker armature 24, from the two ends into the center and, in the busbar 25, outward in opposite directions from the center into the housing 12. Therefore, an electrodynamic force which is directed counter to the force of the spring 27 acts on the striker armature 24. When the set limit value of the current to be disconnected is exceeded, the electrodynamic force brings the striker armature 24 at high speed against the current collector 19. The striker armature 24 strikes the current collector 19 with great force and thus abruptly opens the electrodes 15, 16 counter to the force of the contact pressure spring 23.

Figure 5:
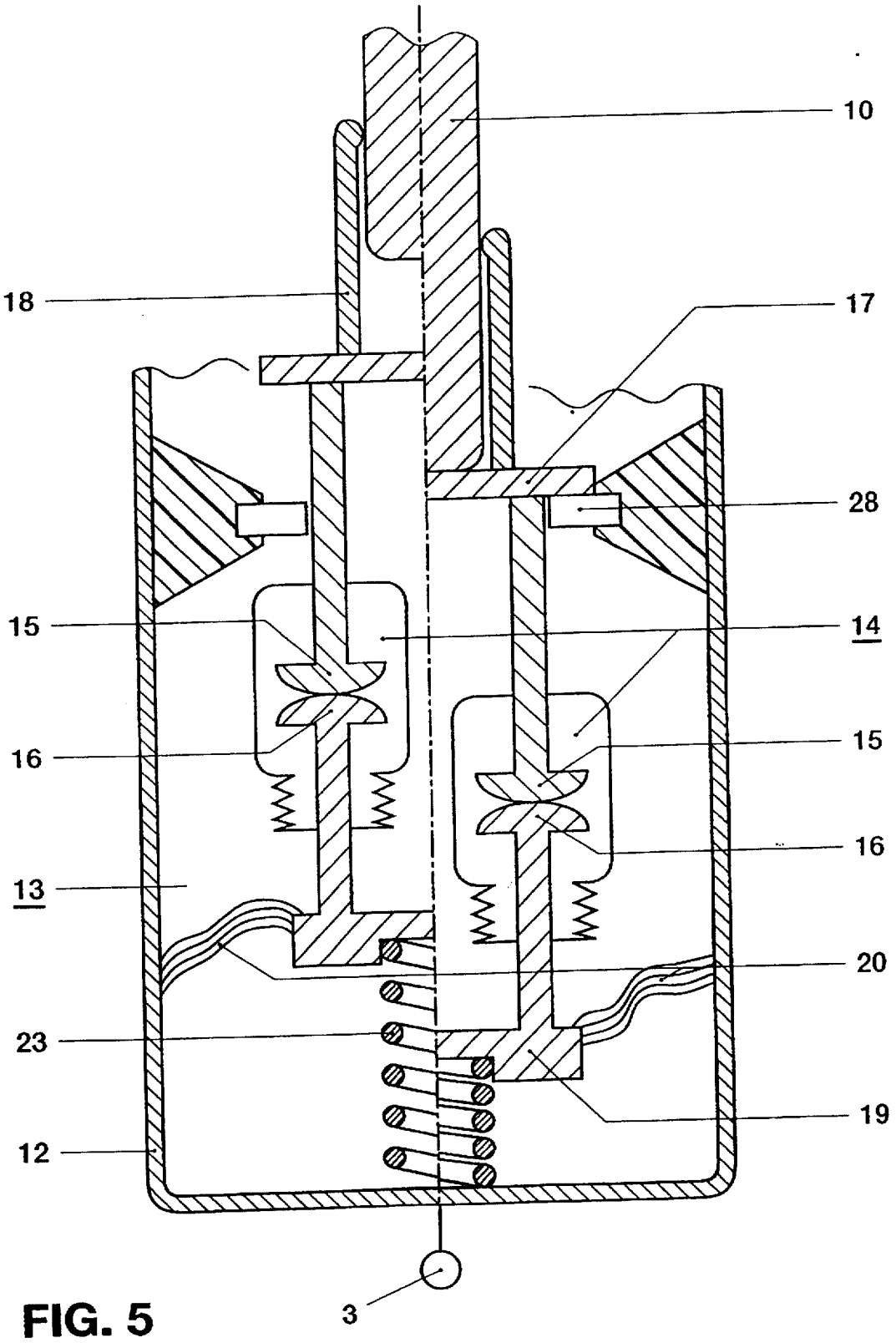
FIG. 5 shows a plan view of an embodiment, which is illustrated in section, of a second switching device according to the invention having a module which contains a plurality of vacuum circuit-breakers.

In the case of the embodiment of the switching device according to the invention illustrated in FIG. 5, only the erosion contact 10 of the compressed gas-blast circuit-breaker is illustrated in addition to the module 13. In contrast to the embodiment in accordance with FIG. 1, the vacuum circuit-breakers 14 of the module 13 and the erosion contact 10 are arranged so as to be displaceable in the direction of the common axis of the housings 1 and 12. The hollow contact 18 which is held by the contact bridge 17 is designed as a sliding contact and constantly makes contact with the erosion contact 10, which is designed to be movable, during a switching operation.

During switching off, the erosion contact 7 is guided downward by a drive (not illustrated). After the rated current path has been opened, the current to be disconnected commutates into the extinction current path and flows from the downwardly guided erosion contact 10 to the current connection 3 (left-hand part of FIG. 5) via the hollow contact 18, the contact bridge 17, the closed electrodes 15, 16, the current collector 19, the flexible conductor elements 20 and the housing 12. As its downward movement continues, the erosion contact 10 strikes the contact bridge 17 and then guides the contact bridge 17, the vacuum circuit-breakers 14 and the current collector 19 downward counter to the force of the contact pressure spring 23. After a predetermined further travel, the contact bridge 17 strikes a stop 28 which is held in an insulated manner in the housing 12. The downwardly directed movement of the contact bridge 17 and of the stationary parts of the vacuum circuit-breakers 14 is thereby abruptly checked, whereas the movable electrodes 16 of the vacuum circuit-breakers 14 and the current collector 19 move further downward. This results in an abrupt opening of the switching points of the vacuum circuit-breakers and in the intended interruption of the current to be disconnected.

By lengthening or shortening the travel of the vacuum circuit-breakers 14, the vacuum circuit-breakers 14 can be opened with a longer or shorter delay in relation to the compressed gas-blast circuit-breaker.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for switching electrical current, comprising:

a compressed gas-blast circuit-breaker;

at least one vacuum circuit-breaker (14);

two current connections, the two current connections including a first current connection and a second current connection;

the compressed gas-blast circuit-breaker including a first erosion contact and the at least one vacuum circuit-breaker including a stationary electrode, the first erosion contact being electrically conductively connected to the stationary electrode;

the compressed gas-blast circuit breaker including a second erosion contact, the second erosion contact being electrically conductively connected to the first current connection;

the vacuum circuit breaker including a movable electrode, the movable electrode being electrically conductively connected to the second current connection, the first and second current connections, the first and second erosion contacts, the stationary electrode, and the movable electrode at least partially defining an extinction current path;

a drive, the drive separating the first and second erosion contacts from one another along an axis;

the compressed gas circuit-breaker including two rated current contacts, the two rated current contacts including a first rated current contact and a second rated current contact, the first and second rated current contacts being electrically conductively connected to the first and second current connections, respectively, and at least partially defining a rated current path arranged in parallel between the first and second current connections with the extinction current path, the drive separating the first and second rated current contacts prior to separating the first and second erosion contacts such that a current is commutated into the extinction current path after the first and second rated current contacts are separated; and means for providing a contact pressure force on the stationary electrode and the movable electrode, the contact pressure force being sufficient to prevent the second drive from separating the stationary electrode and the movable electrode at a current below a limit value of the commutated current, wherein the movable electrode is movable in an axial direction and electrodynamic forces act on the stationary electrode and the movable electrode to cause the movable electrode to separate from the stationary electrode when the limit value of the commutated current is reached.

2. A device for switching electrical current, comprising:

a compressed gas-blast circuit-breaker;

at least one vacuum circuit-breaker;

two current connections including a first current connection and a second current connection;

the compressed gas-blast circuit-breaker including a first erosion contact and the vacuum circuit-breaker including a stations electrode, the first erosion contact being electrically connected to the stationary electrode p(15) of the at least one vacuum circuit-breaker (14);

the compressed gas-blast circuit-breaker including a second erosion contact electrically conductively connected to the first current connection;

the vacuum circuit-breaker including a movable electrode electrically conductively connected to the second current connection the first and second current connections, the first and second erosion contacts, and the stationary and movable electrodes at least partially defining an extinction current path;

a drive, the drive separating the two erosion contacts from one another along an axis;

the compressed gas-blast circuit-breaker including a first rated contact and a second rated contact, the first rated contact and the second rated contact being electrically conductively connected to the first current connection and the second current connection, respectively, and at least partially defining a rated current path arranged in parallel with the extinction current path, the drive separating the first and second rated current contacts prior to separating the first and second erosion contacts such that a current is commutated into the extinction current path after the first and second rated current contacts are separated;

wherein the at least one vacuum circuit-breaker is displaceable in an axial direction and electrodynamic forces act on the at least one vacuum circuit-breaker to cause the at least one vacuum circuit breaker to move in the axial direction when a limit value of the commutated current is reached.

3. The switching device as claimed in claim 1, the at least one vacuum circuit-breaker includes two or more vacuum circuit-breakers connected in parallel with one another.

4. The switching device as claimed in claim 3, wherein the two or more vacuum circuit-breakers include three vacuum circuit-breakers, each of the vacuum circuit-breakers being arranged at respective corners of an equilateral triangle.

5. The switching device as claimed in claim 3, wherein the vacuum circuit-breakers are arranged in a module, the module including a contact bridge and a current collector, wherein the stationary electrodes of the vacuum circuit-breakers and a contact, the contact interacting with a mating contact of the compressed gas-blast circuit-breaker, are electrically conductively fixed on opposite sides of the contact bridge, and wherein the movable electrodes of the vacuum circuit-breakers are rigidly held by the current collector and are electrically conductively connected to the second current connection by the current collector and at least one flexible conductor element.

6. The switching device as claimed in claim 5, wherein the current collector is part of a drive system, the drive system being actuated by the current to be disconnected, of the module.

7. The switching device as claimed in claim 6, wherein the drive system has a spring which is supported on the current collector and applies contact pressure force to the movable electrodes.

8. The switching device as claimed in claim 7, wherein the module is flanged onto the compressed gas-blast circuit-breaker.

9. The switching device as claimed in claim 8, wherein the spring constant of the spring and the inertial masses of the current collector of the movable electrodes which are rigidly connected thereto and also of further moving parts of the module are sufficient to prevent the movable and stationary electrodes from closing until after the current to be disconnected has been interrupted.

10. The switching device as claimed in claim 8, wherein the spring is a spiral or helix and is arranged in the extinction current path between the current collector and the second current connection.

11. The switching device as claimed in claim 8, wherein a movable striker armature and a stationary busbar, which interacts with the striker armature, are connected in series in the extinction current path between the current collector and the second current connection.

12. The switching device as claimed in claim 2, wherein the contact held by the contact bridge is a sliding contact, and wherein the mating contact, which interacts with the sliding contact, of the compressed gas-blast circuit-breaker is movable and, during switching off, concomitantly moves the vacuum circuit-breakers of the module until movement of the vacuum circuit-breakers is checked as a result of striking a stationary stop.

13. The switching device as claimed in claim 2, wherein the at least one vacuum circuit-breaker includes two or more vacuum circuit-breakers connected in parallel with one another.

14. The switching device as claimed in claim 13, wherein the two or more vacuum circuit-breakers include three vacuum circuit-breakers, each of the vacuum circuit-breakers being arranged at respective corners of an equilateral triangle.

* * * * *